US008066060B2

(12) United States Patent
Herrmann

(10) Patent No.: US 8,066,060 B2
(45) Date of Patent: Nov. 29, 2011

(54) PORTABLE DOWN HOLE TOOL

(76) Inventor: Daniel Ray Herrmann, Victor, ID (US)

( * ) Notice: Subject to any disclaimer, the term of this patent is extended or adjusted under 35 U.S.C. 154(b) by 298 days.

(21) Appl. No.: 12/456,129

(22) Filed: Jun. 12, 2009

(65) Prior Publication Data

US 2010/0314095 A1 Dec. 16, 2010

(51) Int. Cl.
*E21B 36/04* (2006.01)
*E21B 43/24* (2006.01)

(52) U.S. Cl. ..... 166/60; 166/57; 166/170

(58) Field of Classification Search ..... 166/57, 166/60, 65.1, 170, 177.3, 311
See application file for complete search history.

(56) References Cited

U.S. PATENT DOCUMENTS 1,232,736 A * 7/1917 Truman ..... 392/305
3,438,444 A * 4/1969 Wilkerson ..... 166/304
4,624,136 A 11/1986 Delatorre et al.
5,168,929 A 12/1992 Galloway
5,516,603 A * 5/1996 Holcombe ..... 429/127
6,076,603 A 6/2000 Perrin
7,258,169 B2 8/2007 Fripp et al.
7,320,530 B2 1/2008 Maglica
2006/0191681 A1 * 8/2006 Storm et al. ..... 166/250.01
* cited by examiner

*Primary Examiner* — David Bagnell
*Assistant Examiner* — Richard Alker
(74) *Attorney, Agent, or Firm* — Ryan L. Marshall; Brinks Hofer Gilson & Lione

(57) ABSTRACT

During the production of crude oil, naturally occurring paraffin can be deposited on the inside surfaces of production tubing. These wax deposits reduce the cross sectional area of the tubing and can reduce or completely halt the flow of oil from the well.
Currently there are many different methods employed in oil fields around the world to combat paraffin problems, but none are one hundred percent effective. When the available methods fail completely, costly removal and replacement of the tubing must be performed in order to resume oil production. The hot anti-wax knife tool provides a previously unavailable method of melting a hole through the paraffin deposits in the production tubing in order to restore production. The tool utilizes rechargeable batteries in a novel arrangement which provides sufficient power to melt through paraffin using a uniquely designed heating element and cutting head.

20 Claims, 4 Drawing Sheets

FIG. 4
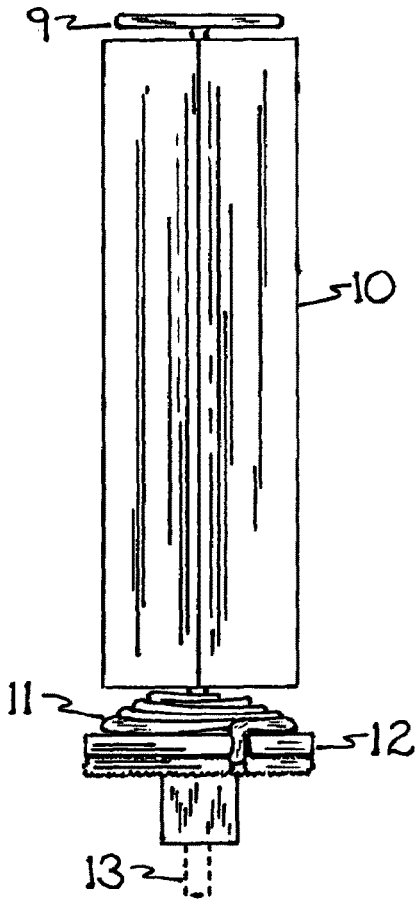
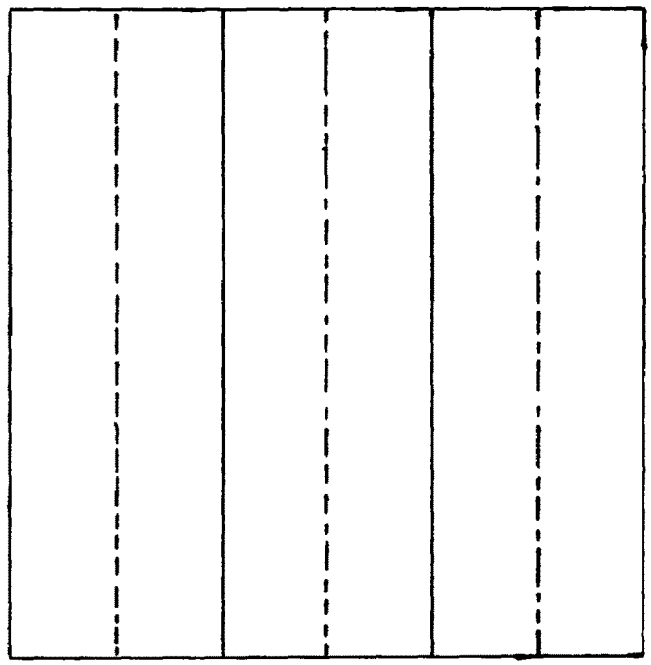
FIG. 5
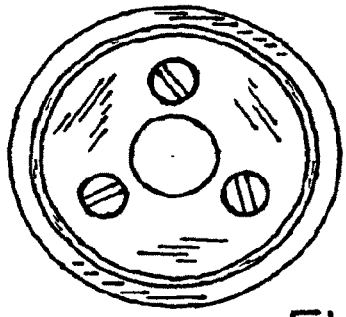
FIG. 7
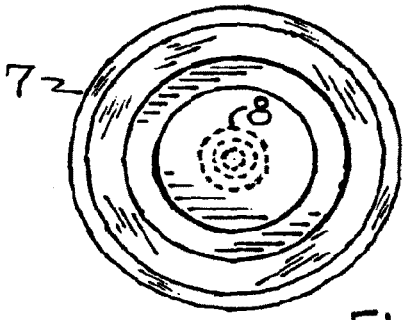
FIG. 6
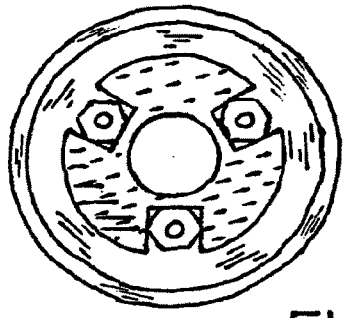
FIG. 8

PORTABLE DOWN HOLE TOOL

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

In the upstream Oil and Gas Industry, paraffin, wax and asphaltene deposits on the inside surface of production tubing in oil and gas wells reduce the cross sectional area of the pipe. The reduction in the cross sectional area increases the flowing friction pressures which can reduce or completely halt production from the producing well.

Currently there are many existing methods, procedures and chemicals employed by Operators to combat paraffin in oil fields around the world where paraffin problems occur. Some of these practices include: Circulating the well with Hot Oil or Hot Water; Wireline wax cutting with various diameter gauge ring cutters or wax knives; The injection of various chemicals, paraffin inhibitors, crystal modifiers, and solvents via capillary tube, surface applications and "squeezes"; There are anti-wax sticks available which are dropped down the annulus of the well, and magnetic devices claimed to alter or prevent the formation of paraffin crystals; and there are downhole electric heaters, with a surface supplied electrical power source to raise the temperature of produced fluids above the melting point of paraffin.

However, many of these methods have limited effect or application in controlling paraffin, some even cause additional operational problems, and the battle against paraffin continues to hamper oil production operations everywhere.

Without effective treatment or removal of paraffin, oil wells can quickly stop producing due to the lack of a continuous flow conduit to the surface, and in most cases requires that the tubing be pulled and replaced in order to resume production. The loss in oil productivity due to the reduction in flow rate caused by paraffin deposition, and the costs associated with Well Service work to replace tubing are two of the constant operational costs that Operators face while producing oil from paraffin prone oil and gas fields.

The hot anti-wax knife tool provides a new and previously unavailable method of cutting and melting a hole though the wax deposited in the production tubing in order to resume the flow of produced fluids. The tool is an invention borne of necessity.

Normally occurring paraffin wax has a melting temperature of about 90 degrees Celsius. With fully charged batteries, the tool can generate cutting edge temperatures well over 90 degrees Celsius for approximately 30 to 45 minutes, long enough for the tool to be assembled, and run down into the production tubing on Wireline, where it will melt and cut a hole through the paraffin deposits and restore production from the well.

Only since the advent of the Nickel Metal Hydride (Ni-MH) rechargeable battery, is it possible for size AA or AAA batteries to be arranged together in a direct current connection that is both series and parallel. Rechargeable batteries arranged in this manner can provide sufficient power to a heating element over a reasonable period of time, to elevate the temperature of the Cutting Head above the melting point of paraffin inside the tubing. The Ni-MH batteries arranged in this configuration provide a self contained source of electrical energy, augmenting the wax cutting effect of the tool with a heated edge to melt the wax that it contacts.

I have relied extensively on my own experience, education, knowledge of physics and skills to create and realize this idea and design, and the materials used to build the functional prototype were obtained locally. The reference data contained in the "Handbook of Physics" Walter Benenson, John W. Harris, Horst Stocker and Holger Lutz Editors, published in 2002 Springer-Verlag New York, Inc. also greatly aided in the design and creation of this invention.

BRIEF SUMMARY OF THE INVENTION

The hot anti-wax knife combines basic electrical and thermodynamic principles, commonly used and available materials, and two new design components; the series-parallel Battery Pack and the parabolic cone Cutting Head, in a self contained wireline conveyed tool that converts the stored electrical energy contained in the rechargeable batteries into useful heat energy, which is focused, transferred and applied at the cutting and heating edge of the tool. The purpose of the hot anti-wax knife is to cut and melt paraffin from the inside of oil well production tubing. Solar energy is the preferred method for recharging the batteries once spent.

BRIEF DESCRIPTION OF THE SEVERAL VIEWS OF THE DRAWING

FIG. 4 is an elevational view of the Battery Pack Carrier shown without batteries, identifying the Positive Pole wire (9), the Battery Spacer (10), the Negative Pole wire (11) spring and, the Rigid Disk (12). The Pin End Power Connector (13) is shown for illustrative purposes with broken lines and forms no part of the Claim.

FIG. 5 is top plan view of the flat, rectangular, Battery Spacer (10) prior to folding and assembly.

FIG. 6 is a top plan view of the Cutting Head (3).

FIG. 7 is a top plan view of the Separator (2).

FIG. 8 is a bottom plan view of the Separator (2).

FIG. 100 is an elevational view of another embodiment of the hot anti-wax knife.

DETAILED DESCRIPTION OF THE INVENTION

Figure 1:
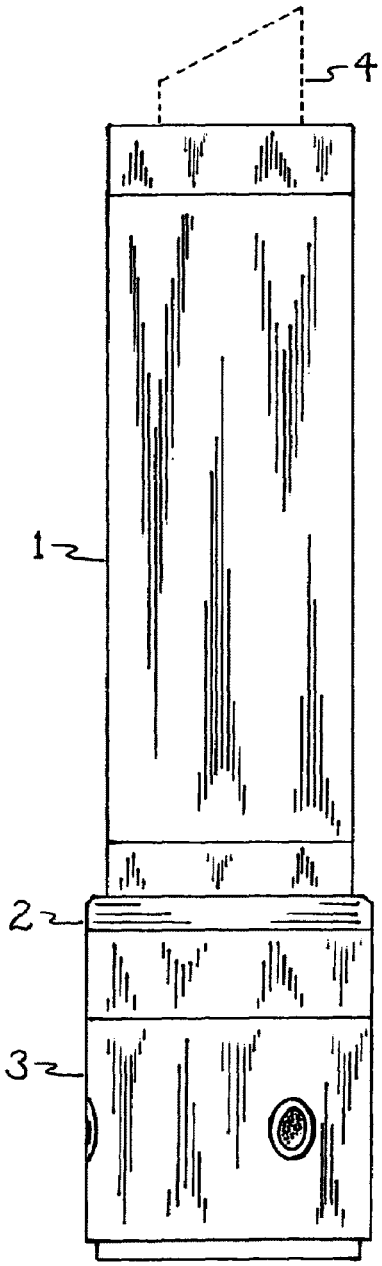
FIG. 1 is an elevational view of the hot anti-wax knife identifying three main elements: the Battery Pack (1); the Separator (2) and; the Cutting Head (3). A truncated section of Sucker Rod (4) is shown with broken lines at the top of the drawing for illustrative purposes and forms no part of the Claim.

The hot anti-wax knife shown assembled in FIG. 1, is a cylindrical, wireline conveyed, rechargeable battery powered tool used to melt and cut paraffin on the inside of oil well tubing. The tool incorporates two new design components; The series-parallel Battery Pack (1), and the parabolic cone Cutting Head (3). The design of each of these elements affects the characteristics and performance of the other and they are therefore inseparable in design, function and operation of the tool.

Modified forms of the hot anti-wax knife include, but are not limited to all of the modified forms of the:

The series-parallel Battery Pack (1) and;

The Separator (2) and;

The parabolic cone Cutting Head (3).

All of the modified forms of the hot anti-wax knife, of which several are shown in FIG. 10, are similar in shape and function, and are individually designed for various well conditions, temperature requirements, and various quantities and sizes of batteries.

The Hot Anti-Wax Knife Battery Pack (1)

The Battery Pack (1) consists of a specially designed Carrier for rechargeable Ni-MH Size "AA" (R6) 1.2 Volt, or size "AAA" (HR03/DC2400) 1.2 Volt batteries which are arranged in both series and parallel connections. The Carrier is contained within a steel tube threaded at both ends to connect with the Separator (2) at the Negative pole end and fitted with a steel cap at the Positive end. The steel cap is welded to a ⅞" Standard API Sucker Rod Pin End (4) for the connection to a Wireline Rope Socket. The Sucker Rod is included in the Specifications and drawings for illustrative purpose only and forms no part of the Claim.

The Battery Pack (1) is spring loaded and the batteries are inserted Negative end first, by removing the End Cap, and withdrawing approximately 5 cm of the positive end of the carrier from the Steel Tube. Batteries are inserted into each of the three sections formed by the Spacer (10) and the inside diameter of the Steel Tube. Each of the three sets of series connected batteries are also connected in parallel to the other two sets via the Positive Pole wire (9) ring and the Negative Pole wire (11) spring. The batteries for a nine battery tool are arranged in sets of three in series, with all three triple sets of series connected batteries also connected in parallel.

The positive ends of three of the batteries make physical and electrical contact with the Positive Pole wire (9) Ring which serves as the positive parallel connection. The remaining straight portion of the wire passes through the center of the Spacer (10) axially towards the Negative ends of the batteries through the center void formed by the three edged star of the Spacer.

At the Negative end, the Positive Pole wire (9) passes through the center hole of the electrical insulation of the Rigid Disk (12), and is fixed in place with epoxy to the disk and soldered on the other side of the disk to the positive pole of the Pin End Power Connector (13). On the battery side of the Rigid Disk (12), a spiral coil of Copper (Cu) wire is fixed creating the Negative Pole parallel connection and acting as a spring to secure the batteries in place and ensure electrical contact. The negative ends of three of the batteries make physical and electrical contact with this spring which forms the negative parallel connection.

Modified forms of the Battery Pack (1) include but are not limited to:

The capacity for four, six, nine, twelve or more size "AA" or size "AAA" rechargeable batteries and;

Various lengths, diameters and materials of the individual elements of the Battery Pack (1) and Carrier, provided that when assembled with the appropriate number of batteries installed, all sets of series connected batteries are also connected in parallel with the other series sets of batteries.

The individual elements of the hot anti-wax knife Battery Pack (1) for six size "AA" (R6) 1.2 Volt batteries, are described as follows:

- Steel Tube. A 38 mm OD, 31.5 mm ID and 13 cm long steel tube with about 7 mm of both ends externally threaded.
- Battery Carrier. This element of the Battery Pack (1) is shown in FIG. 4 and consists of the following individual components:
  - Positive Pole wire (9). Made from a single length of 1.8 mm diameter un-insulated (bare) Copper (Cu) wire approximately 17 cm long, bent and fashioned at one end into a continuous ring of about 2 cm in diameter which is aligned perpendicular and central to the axis of the Battery Pack (1) and the remaining length of straight wire. The terminal end of the wire ring end is soldered to the ring itself forming a continuous circle and the positive end of the parallel battery connection.
  - Battery Spacer (10). Shown in FIG. 4 the Spacer is constructed from a single rectangle of construction paper 8.4 cm wide by 9.5 cm long as depicted in FIG. 5. The paper is alternately folded on five fold lines to form six equal sections of 14 mm width each. The two long free edges are taped flush together on one side with a strip of electrical tape, to form a 9.5 cm long three edged "star" which supports and separates the sets of series connected batteries from one another and isolates the batteries from the Positive Pole wire (9) running axially through the center of the Spacer (10).
  - Negative Pole wire (11) spring. This is also a 1.8 mm diameter bare Copper (Cu) wire approximately 21 cm in length, formed into a concentric spiral spring of from 3 to 4 loops, with the largest loop less than 28 cm in diameter. Shown in elevation in FIG. 4.
  - Rigid Disk (12). A disk of circuit board resin electrical insulating material 3 mm thick and 3 cm in diameter with a 4 mm hole drilled through the center and a 2 mm wide notch cut 2 mm into the edge as shown in FIG. 4.
  - Felt Disk. A 3 cm diameter, 3 mm thick felt disk with a 10 mm hole in the center with a 2 mm wide "spoke" cut out from the disk
  - Pin End Power Connector (13) shown in FIG. 4. This is a 3 mm pin end power connection of the type commercially available for charging mobile telephone batteries and forms no part of the Claim.
  - Support Tube: A 10 mm OD and 8 mm ID plastic tube, 13 mm in length, with a 2 mm wide notch cut 2 mm into one end.
- End Cap. A steel cap of 3.8 cm OD, 31.5 mm ID with a 5 mm end wall thickness, 12 mm in length and threaded for 7 mm on the inside.
- End Cap Plug. A cylinder of rubber 3 cm in diameter and 14 mm in length.
- Sucker Rod (4). Used for the connection to a Wireline Rope Socket, this is a 15 cm long Standard API ⅞" Sucker Rod pin end. The Sucker Rod is welded at the rod end to the center of the outside end of the End Cap. Although the Sucker Rod (4), or any similarly constructed connection is required in order to use the tool by Wireline, the API ⅞" Sucker Rod (4) itself forms no part of the Claim.

The hot anti-wax knife Battery Pack (1) and Carrier for six size "AA" batteries is constructed in the following manner:

A. Battery Pack Carrier:

a. The end of the Negative Pole wire (11) that is not part of the spring coil, is bent around the edge of the Rigid Disk (12), through the notch on the Rigid Disk and in a radial direction towards the center hole of the Rigid Disk. The terminating end is bent so that is rests parallel to the opposite side face of the Rigid Disk (12) and the last three of four millimeters of wire is bent parallel along the axis of the Carrier at the center hole of the Rigid Disk.

b. The Negative Pole wire (11) terminus is soldered to the negative pole of the Pin End Power Connector (13).

c. The straight end of the Positive Pole wire (9) is inserted through the center hole of the Rigid Disk (12), and glued in place with epoxy keeping 10.3 cm between the facing surfaces of the Positive Pole wire ring end and the near side of the Rigid Disk.

d. The straight end of the Positive Pole wire (9) terminal end is soldered to the positive pole of the Pin End Power Connector (13).

e. The plastic Support Tube is placed over the Pin End Power Connector (13) and wire terminal connections. The 2 mm notch in the Support Tube is aligned to fit over the Negative Pole wire (11) and the tube is glued in place with epoxy.

f. The construction paper Battery Spacer (10) is spread opened at one end and the Positive Pole wire (9) ring end is inserted ring first into the paper Spacer and pushed through and out the other side.

g. The felt disk is glued onto the power connection side of the Rigid Disk (12).

h. The above completed Carrier assembly is fully inserted into the Steel Tube.

B. The End Cap Plug is glued centrally to the inside end of the End Cap with epoxy glue.

C. The End Cap is screwed onto the end of the Steel Tube at the positive pole end of the battery Carrier, completing the Battery Pack (1).

The Battery Pack (1) screws into the Separator (2), which is screwed into the Cutting Head (3). The Battery Pack (1) is thermally insulated from the Cutting Head (3) by a disk of pressed asbestos thermal insulation contained within the Separator (2).

The total number, charge capacities and arrangement of either size "AAA" or "AA" rechargeable batteries in the Battery Pack (1) determines the Ohmic resistance requirement of the heating coil in the Cutting Head (3) in order to transfer an adequate amount of useful heat energy to the Cutting Edge (6) without over heating the batteries.

The Hot Anti-Wax Knife Separator (2)

This element of the tool provides thermal insulation between the Cutting Head (3) and the Battery Pack (1), while still allowing for the required electrical connection. Views of the Separator (2) are shown in FIGS. 1, 7 and 8. The Separator (2) consists of a washer of thermal insulation "sandwiched" between two steel "end caps", one the same outside diameter as the Cutting Head (3), and the other the same outside diameter as the Battery Pack (1).

Modified forms of the Separator (2) include but are not limited to;

Various diameters, materials, lengths and thicknesses of the individual elements, provided that the complete Separator (2) physically and rigidly connects the Battery Pack (1) and the Cutting Head (3) together, and provides thermal insulation between them while providing a conduit for the electrical connection.

The individual elements of a hot anti-wax knife Separator (2) are described as follows:

Battery End Cap. A steel cap of 38 mm OD, 31.5 mm ID and 9 mm in length, threaded internally to connect to the Steel Tube of the Battery Pack (1). The cap has a 12 mm diameter hole through the center of the 2 mm thick end wall. The cap also has three 4 mm diameter holes at 120 degrees phasing at 11 mm radius from the center drilled axially through the end. The three 4 mm holes are counter sunk on the inside surface of the cap to accommodate machine bolt screw heads as shown in FIG. 7.

Head End Cap. A steel cap of 44 mm OD, 39.5 mm ID and 1.5 cm in length, threaded internally to connect to the Casing (7) of the Cutting Head (3). It has a 12 mm diameter hole drilled through the center of the 5 mm thick end wall. This cap also has three 4 mm diameter holes at 120 degrees phasing at 11 mm radius from the center drilled axially through the end.

Insulator. A 6 mm thick pressed Asbestos or Cork washer of 44 mm diameter with a 12 mm diameter hole in the center, and three 4 mm holes at 120 degrees phasing at 11 mm radius from the center.

Cork Washer. A 29 mm diameter disk of Cork, 6 mm thick, with a 12 mm hole in the center and three 7 mm wide notches cut 6 mm into the edge at 120 degrees phasing.

The hot anti-wax knife tool Separator (2) is constructed in the following manner:

A. The Insulator is sandwiched between the flat ends of the two end caps and the holes are aligned.

B. Three size M3 flat head machine bolts of 18 mm length are inserted through the end caps from the Battery side cap and secured with nuts at the Head end.

C. The Cork Washer is placed inside the Head End Cap, with the edge notches aligned with the protruding bolts and nuts to complete the Separator (2). A bottom plan view of the assembled Separator (2) is shown in FIG. 8.

The Hot Anti-Wax Knife Cutting Head (3)

The Cutting Head (3), as shown in FIGS. 1, 2, 3 and 6, utilizes a unique design of common materials and naturally occurring shapes in order to effectively transfer electrical energy from the batteries in the Battery Pack (1) into useful heat energy at the Cutting Edge (6). A Copper (Cu) coil with a specific resistivity and length, is wound in a spiral coil onto and in direct contact with the outside surface of the apex end of a Tin (Sn) parabaloid or Parabolic Cone (5). The opposite end of the parabaloid is concave and only the circular edge and rim of the concave end of the parabaloid forms the actual heating and Cutting Edge (6) of the tool.

The Tin parabaloid with the Copper spiral heating coil in place, is insulated with layers of epoxy, aluminum foil, epoxy resin putty, and asbestos string to retain as much heat as possible in the cone, limit radial heat transfer, and promote heat transfer by conduction axially through the metal walls of the Parabolic Cone (5) to the Cutting Edge (6). All but about a 1.5 mm edge and a 3 mm rim of the parabaloid is contained within and sealed inside the steel cylinder of the Casing (7).

The physical dimensions and material of the parabaloid affects the amount of energy required to raise the temperature, and the surface area of the exposed edge and rim affects the rate of heat loss from the Cutting Head (3) into the environment. Tin (Sn) was selected for the parabaloid due to its relatively low Specific Heat Capacity and low Thermal Conductivity. The dimensions of the Parabolic Cone (5) of the Cutting Head (3) determine the energy requirement from the batteries, which in turn affects the design length and required resistance of the Copper heating coil in the Cutting Head. Therefore these two elements, the Cutting Head (3) and the Battery Pack (1), are inseparable in the tool design, form, function and performance.

Modified forms of the Cutting Head (3) include but are not limited to:

- Various cross sectional areas, lengths, number of loops and resistance of the Copper (Cu) wire heating coil and;
- Various lengths, diameters, volumes and mass and material of the Parabolic Cone (5) and;
- Various lengths and diameters and materials of the Casing (7) and the holes therein and;
- Various adhesives, epoxy resins and thermal insulation.
- Each of these elements affects the thermodynamic characteristics of the Cutting Head (3), and the energy requirement from the Battery Pack (1).

Figure 2:
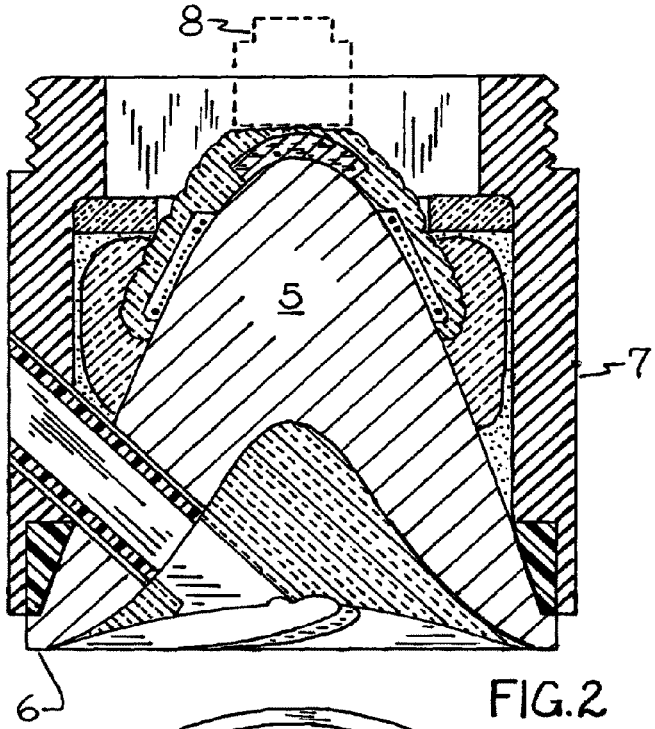
FIG. 2 is a cross section of the Cutting Head (3) identifying the Parabolic Cone (5), the Cutting Edge (6) and the Casing (7). The Receiver End Power Connector (8) is shown for illustrative purposes with broken lines and forms no part of the Claim.

The individual major components of a hot anti-wax knife Cutting Head (3) designed for a six size AA 1.2 volt Battery Pack (1) are described below and shown in cross section in FIG. 2:

- Parabolic Cone (5). A solid Tin (Sn) parabaloid 42 mm in length and 41 mm in diameter at the widest and concave end, and approximately 200 gm in mass.
- Heating Coil. One 0.2 mm diameter un-insulated Copper (Cu) wire of 120 cm in length is used to form the spiral heating coil. The terminal ends of this wire are each soldered to 30 cm lengths of 0.4 mm Copper (Cu) wire for construction and end connections.
- Casing (7) as shown in cross section in FIG. 2. This is a 4.4 cm OD steel cylindrical tube 4.6 cm in length with a 7.5 mm wall thickness. It is milled internally from one end to an ID of 4.1 cm for 8 mm, and to an ID of 3.4 cm for 3.6 cm from the end. At the opposite end, the Casing (7) is externally milled and threaded to an OD of 39.5 mm for 8 mm from the end to accept Head End Cap of the Separator (2).
- Casing Ring. A 41 mm OD, 34 mm ID ring of stiff PVC, 8 mm in length, and beveled internally at one end to accommodate the external dimensions of the concave end of the parabaloid.
- Cone Washer. A 3 mm thick pressed asbestos washer 34 mm in diameter with a 21 mm hole in the center and fits in the annular space between the Parabolic Cone (5) and the inside of the Casing (7).
- Receiver End Power Connector (8). A commercially available power connection from a mobile phone battery charger. This is the receiving end of the Pin End Power Connector (13) and is shown for illustration purposes in FIGS. 2 and 6, and forms no part of the Claim.
- Cork Disk. A 2 mm thick, 12 mm diameter disk of cork.
- Hole Insulator Tubes. Three plastic tubes of 7 mm OD and 5 mm ID and about 25 mm in length.

A hot anti-wax knife Cutting Head (3) for a six size AA battery tool is constructed in the following manner:

A. Melted candle wax is poured into an empty 42 mm ID cardboard tube to a height of 50 mm and allowed to cool. (NOTE: An inverted "bell" shaped concave depression will form in the top of the wax cylinder due to changes in density and volume of the wax as it cools. This is the "naturally occurring shape" mentioned previously in this section). A parabaloid of the designed dimensions is shaped from the wax cylinder with the apex opposite the concave end. Using the "lost wax" casting technique, plaster is poured over the wax parabaloid. Once dried, the plaster cast is heated allowing the wax to melt and pour out, leaving a cavity of the wax parabaloid shape in the plaster casting. Molten Tin (Sn) is poured into the plaster cast. The cast is broken apart and the resulting Tin (Sn) parabaloid is cleaned and shaped to the final design dimensions with a file.

B. The 34 mm diameter pressed asbestos Cone Washer is glued onto the rim of the internal upset of the Casing (7) with epoxy.

C. The Casing Ring is glued into the internal upset of the Casing (7) at the non-threaded end and then beveled internally to match the outer circumference of the concave end of the Parabolic Cone (5).

D. The Parabolic Cone (5) is fitted inside the Casing (7), with the apex protruding though the asbestos Cone Washer.

E. The Tin cone is temporarily secured in place inside the Casing (7) with clamps.

F. Three 8 mm holes are drilled through the sides (walls) of the Parabolic Cone (5) and the Casing (7), from the center radially outward at equal intervals and spacing of 120 degrees phasing and at 45 degrees to the central axis. The holes pass through the center of the plane formed by the circular edge of the concave end of the parabaloid.

G. The clamps are removed and the parabaloid is removed from the Casing (7).

H. The Copper wire is wrapped around and onto the apex end of the bare outer surface of the parabaloid beginning at about 5.5 mm from the apex. While holding tension on the end of the wire after the last loop is in place, the wire coil is covered with a thin layer of epoxy to secure the coils in place and to reduce exposure of the wire to the atmosphere.

I. The heating coil is then covered with a single layer of aluminum foil.

J. One terminal end of the coil is soldered to the Positive pole of the Receiver End Power Connector (8) and the other end of the coil is soldered to the Negative pole. The Cork Disk is placed between the exposed apex of the Tin parabaloid and the bottom of the Receiver End Power Connector (8) for thermal insulation.

K. A 3 mm thick layer of epoxy putty is applied over the heating coil wire, Cork Disk, and the terminal connections of the Receiver End Power Connector (8) securing them in place.

L. Approximately the middle one third of the length of the parabaloid is wrapped with asbestos string which is then covered with a single layer of aluminum foil.

M. The Tin Parabolic Cone (5) is again placed inside the Casing (7), with the existing holes aligned with the holes in the Casing.

N. A cardboard sleeve is placed around and tapped onto the circumference of the Casing (7), in order to temporarily cover the three 8 mm holes.

O. The parabaloid is again temporarily held in place with clamps.

P. Using a caulking gun and a tube of adhesive, glue is injected into each of the three 8 mm holes of the Tin paraboloid, until adhesive completely fills the annular space between the parabaloid and the Casing (7) and is extruded under pressure through any remaining gaps or holes.

Q. The adhesive is allowed to fully cure.

R. Three 8 mm holes are drilled through the adhesive filled holes of the parabaloid and Casing (7).

S. The three 7 mm OD Plastic Tubes are inserted and glued with epoxy into the three 8 mm holes in the parabaloid and Casing (7). The ends of the plastic tubes are trimmed to fit the inside surface contour of the Tin parabaloid and the outside surface of the Casing (7).

T. Epoxy putty is used to partially fill the concave end of the parabaloid, the final exposed putty surface is made slightly concave, leaving only a 1.5 mm wide ring of cutting and heating edge of Tin exposed to the environment.

U. Three 6 mm holes are drilled through the epoxy putty, aligned with the inserted plastic tubes in the parabaloid and Casing (7).

Figure 3:
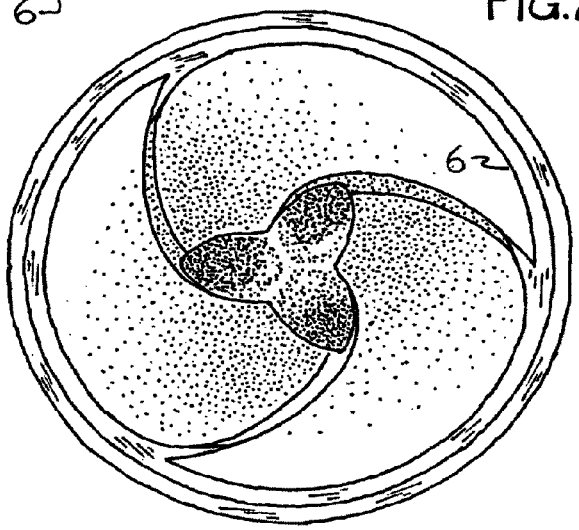
FIG. 3 is a bottom plan view of the Cutting Head (3).
Figure 9:
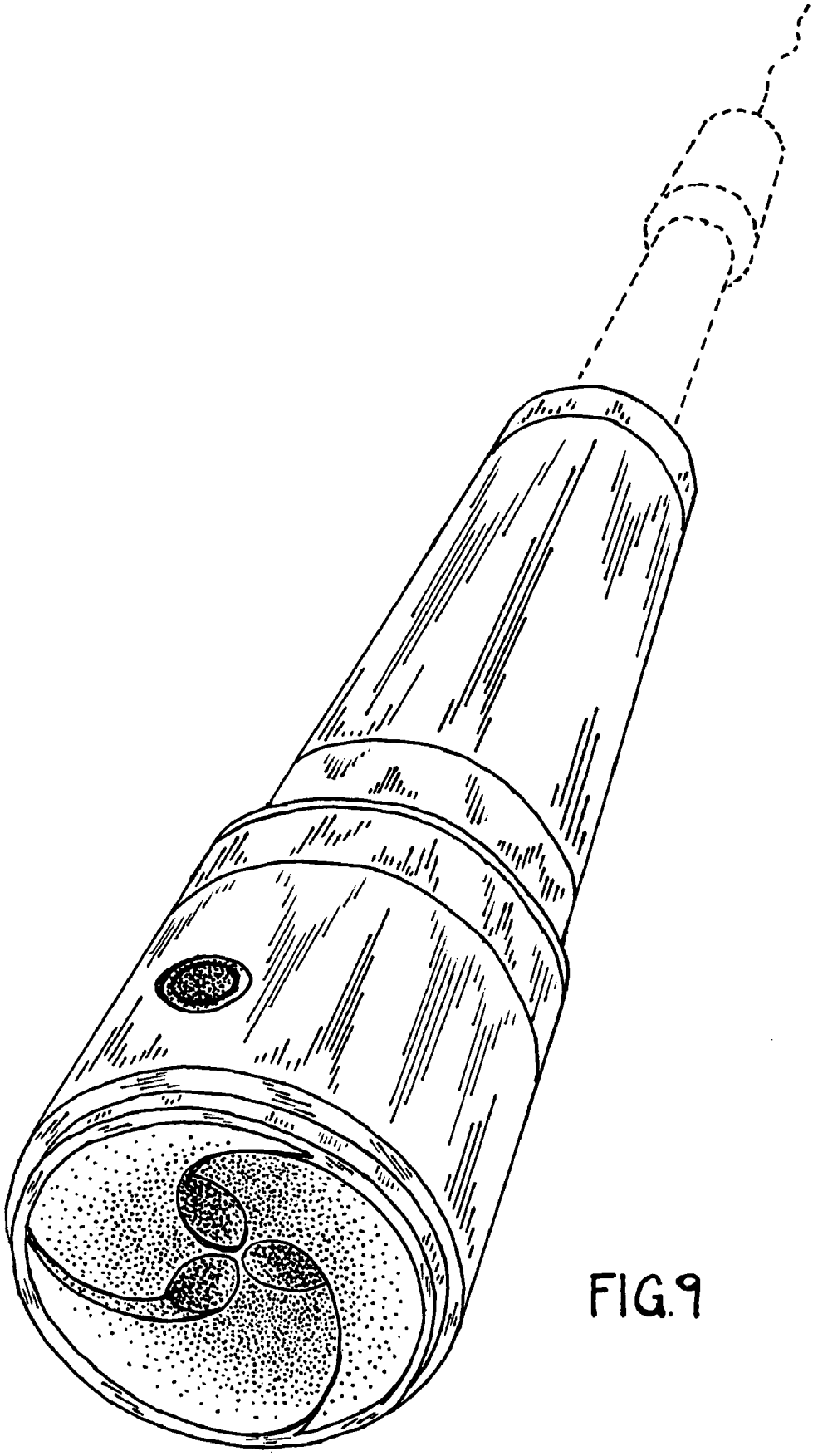
FIG. 9 is a perspective view of the hot anti-wax knife.
Figure 10A:
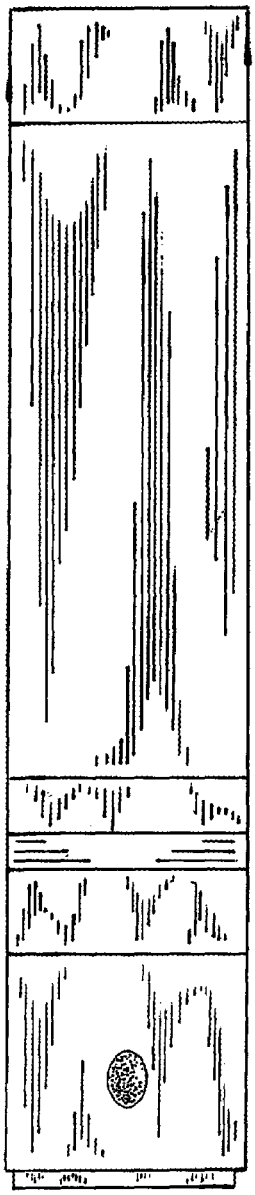
FIG. 10A is an elevational view of one embodiment of the hot anti-wax knife.
Figure 10B:
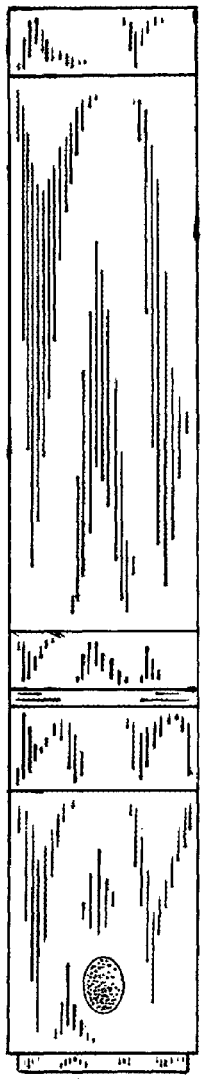
FIG. 10B is an elevational view of another embodiment of the hot anti-wax knife.
Figure 10C:
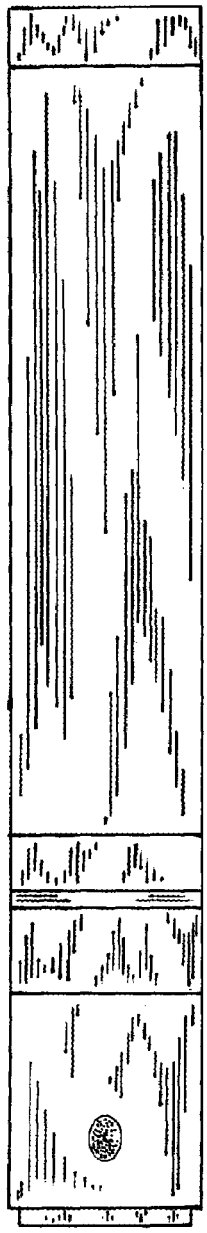
FIG. 10D is an elevational view of another embodiment of the hot anti-wax knife.
Figure 10D:
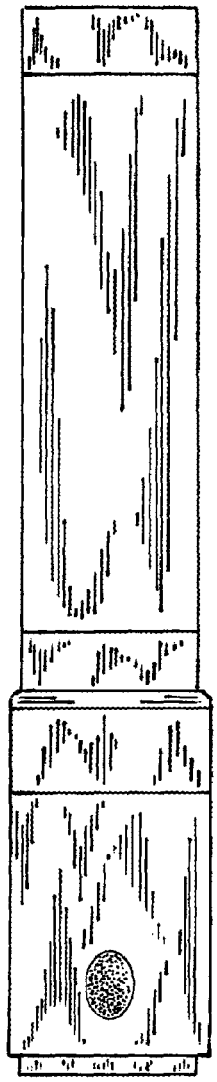

V. Finally, the surface of the exposed face of the cured and concave epoxy putty of the Cutting Head (3) is carved in relief with three wide, spiraling grooves, shaped like curved "tear drops" starting shallow from the exposed Cutting Edge (6) of the Parabolic Cone (5) and progressively carved deeper towards the center and converging with each of the three 6 mm diameter holes in the center face of the Cutting Head (3) as shown in FIG. 3. These channels have a maximum depth of about 2 mm at the central holes and allow wax that has melted at the edge of the tool to flow centrally towards the three 45 degree holes in the face and be discharged or extruded to the outside of the tool.

The invention claimed is:

1. A down hole tool comprising:

a power source;

a cutting head operably connected to the power source, the cutting head further comprising:

a first end and a second end;

a casing that encloses a parabolic cone;

a heating element in contact with an outside portion of the parabolic cone;

an insulating separator adjacently disposed between the first end of the cutting head and the power source.

2. The down hole tool of claim 1, further comprising one or more channels passing through the cutting head casing and extending radially to the second end of the cutting head.

3. The down hole tool of claim 1, further comprising insulating material disposed between the heating element and the casing.

4. The down hole tool of claim 1, wherein the parabolic cone at its widest portion has a cutting edge which is located at the second end of the cutting head.

5. The down hole tool of claim 1, wherein the parabolic cone is made of tin.

6. The down hole tool of claim 1, further comprising a power connector operably connecting the heating element to the power source, the power connector being located at the first end of the cutting head.

7. The down hole tool of claim 1, wherein the power source is a plurality of batteries.

8. The down hole tool of claim 7, wherein some of the plurality of batteries are operably connected to one another in series, and some of the plurality of batteries are operably connected on one another in parallel.

9. The down hole tool of claim 1, wherein the heating element is circumferentially located about a portion of the parabolic cone within the casing.

10. A method for opening a pipe blocked by solidified petroleum components, comprising:

providing a down hole tool comprising:

a power source;

a cutting head operably connected to the power source, the cutting head further comprising:

a first end and a second end;

a casing that encloses a parabolic cone;

a heating element in contact with an outside portion of the parabolic cone;

an insulating separator adjacently disposed between the first end of the cutting head and the power source, actuating the heating element with power from the power source.

11. The method of claim 10, wherein down hole tool further comprises one or more channels passing through the cutting head casing and extending radially to the second end of the cutting head.

12. The method of claim 10, wherein the down hole tool further comprises insulating material disposed between the heating element and the casing.

13. The method of claim 10, wherein the parabolic cone at its widest portion has a cutting edge which is located at the second end of the cutting head.

14. The method of claim 10, wherein the parabolic cone is made of tin.

15. The method of claim 10, wherein the down hole tool further comprises a power connector operably connecting the heating element to the power source, the power connector being located at the first end of the cutting head.

16. The method of claim 10, wherein the power source is a plurality of batteries.

17. The method of claim 16, wherein some of the plurality of batteries are operably connected to one another in series, and some of the plurality of batteries are operably connected on one another in parallel.

18. The method of claim 16, wherein the heating element is circumferentially located about a portion of the parabolic cone within the casing.

19. The method of claim 10, further comprising the step of conveying the tool through a pipe using a wireline.

20. The method of claim 10, further comprising the step of directing the down hole tool to an occluded location of a pipe.

* * * * *